United States Patent [19]

Willcocks

[11] Patent Number: 4,525,855

[45] Date of Patent: Jun. 25, 1985

[54] VARIABLE RATE AND VARIABLE LIMIT DIMENSION CONTROLS FOR A DIRECTIONAL ENHANCEMENT SYSTEM

[75] Inventor: Martin E. G. Willcocks, Somersham, England

[73] Assignees: John C. Bogue, Los Angeles; Wesley Ruggles, Jr., Marina Del Ray, both of Calif.

[21] Appl. No.: 497,216

[22] Filed: May 25, 1983

Related U.S. Application Data

[63] Continuation of Ser. No. 296,881, Aug. 27, 1981, abandoned, which is a continuation of Ser. No. 19,617, Mar. 12, 1979, abandoned, which is a continuation of Ser. No. 885,959, Mar. 13, 1978, abandoned, which is a continuation of Ser. No. 799,437, Mar. 23, 1977, abandoned, which is a continuation of Ser. No. 667,513, Mar. 16, 1976, abandoned.

[51] Int. Cl.[3] ..... H04S 3/02

[52] U.S. Cl. ..... 381/22; 381/20

[58] Field of Search ..... 381/22, 19, 20, 21, 381/23; 369/89, 90, 88

[56] References Cited

U.S. PATENT DOCUMENTS

| | | | |
|---|---|---|---|
| 3,708,631 | 1/1973 | Bauer et al. | 381/23 |
| 3,864,516 | 2/1975 | Kameoka et al. | 381/22 |
| 3,883,692 | 5/1975 | Tsurushima | 381/22 |
| 3,944,735 | 3/1976 | Willcocks | 179/1 GQ |

*Primary Examiner*—Douglas W. Olms
*Attorney, Agent, or Firm*—Jim Zegeer

[57] ABSTRACT

The disclosed invention relates to directional enhancement systems and provides apparatus for enhancing the directional content of information contained in a plurality of composite signals derived from preceding decoding apparatus of the system. The apparatus of this invention includes a plurality of limiting devices equal in number to the number of control signals provided in the processor of the directional enhancement system. Each one of the plurality of limiting devices has an input terminal connected to a different one of the control signal outputs of the processor, a control terminal and a control device having an input coupled to a variable control voltage source and an output coupled in common to all of the control terminals of said limiting device. The apparatus of this invention limits any control signal which may be developed in the processor to a value less than or equal to that which would obtain in the absence of the dimension control apparatus of this invention.

2 Claims, 2 Drawing Figures

CHARGING DEVICES
101
BUFFERS
125
LIMITERS
137
145
146
OR GATES
131
107
LIMITERS
113
CHARGE STORAGE
119
DISCHARGE MEANS
126
138
102
132
108
114
120
OUTPUTS TO COEFFICIENT GENERATOR
103
127
139
133
INPUTS FROM DETECTOR
109
115
121
143
USER CONTROL
104
128
144
CONTROL MEANS
134
140
110
116
122
VARIABLE LIMIT DIMENSION CONTROL (OPTIONAL)
105
129
141
135
111
117
123
106
130
142
136
112
118
124
AUTOMATIC DIMENSION CONTROL SYSTEM
PART OF PROCESSOR OF PRIOR ART

VARIABLE RATE AND VARIABLE LIMIT DIMENSION CONTROLS FOR A DIRECTIONAL ENHANCEMENT SYSTEM

REFERENCE TO RELATED APPLICATIONS

This application is a continuation of U.S. application Ser. No. 06/296,881 filed Aug. 27, 1981 which, in turn, is a continuation of U.S. application Ser. No. 06/019,617 filed Mar. 12, 1979, which, in turn, is a continuation of U.S. application Ser. No. 05/885,959 filed Mar. 13, 1978, which, in turn, is a continuation of U.S. application Ser. No. 05/799,437 filed Mar. 23, 1977, which, in turn, is a continuation of U.S. application Ser. No. 05/667,513 filed Mar. 16, 1976, all of which are abandoned.

BACKGROUND OF THE INVENTION

This invention is concerned with variable rate and variable limit dimension controls for a directional enhancement system.

The apparatus of this invention is intended for utilization in a directional enhancement system for quadrophonic decoders such as disclosed in co-pending application Ser. No. 472,291 filed May 22, 1974, now U.S. Pat. No. 3,944,735 and the teachings of U.S. Pat. No. 3,944,735 are incorporated herein by reference.

From one aspect, the invention provides in apparatus for enhancing the directional content of information contained in a plurality of composite signals derived from preceding matrix decoding apparatus, a dimension control comprising: a plurality of limiting devices equal in number to the number of control signals provided in the processor of the directional enhancement system, each having an input-output terminal which is connected to the respective one of said control outputs from said processor, and a control terminal, and operative to limit the maximum value of any control voltage to the voltage present at the control terminal; and a control device having an input and an output, the input being connected to a variable control voltage and the output being connected in common to all of the control terminals of said limiting devices, the whole being operative to limit any control signals which may be developed in the processor to a value less than that which would obtain in the absence of the dimension control, and variable by external means to any desired extent.

From another aspect, the invention provides, in apparatus for enhancing the directional content of information contained in a plurality of composite signals derived from preceding decoding apparatus, a dimension control comprising: voltage-variable resistors equal in number to the number of control signals provided in the directional enhancement system, each having a resistive current path and a control terminal: the resistive current paths each forming part of the discharging devices of the attack-decay control circuits of the processor, and the control terminals being connected in common to an externally variable voltage, the whole being operative to vary by means of the external control the rate of decay of charge of each of the charge storage devices forming part of the attack-decay circuit of the processor of the directional enhancement system.

BRIEF DESCRIPTION OF THE DRAWING

A complete understanding of the invention can be obtained from the following detailed description of the invention when read in conjunction with the annexed drawing in which.

DETAILED DESCRIPTION OF THE INVENTION

Figure 1:
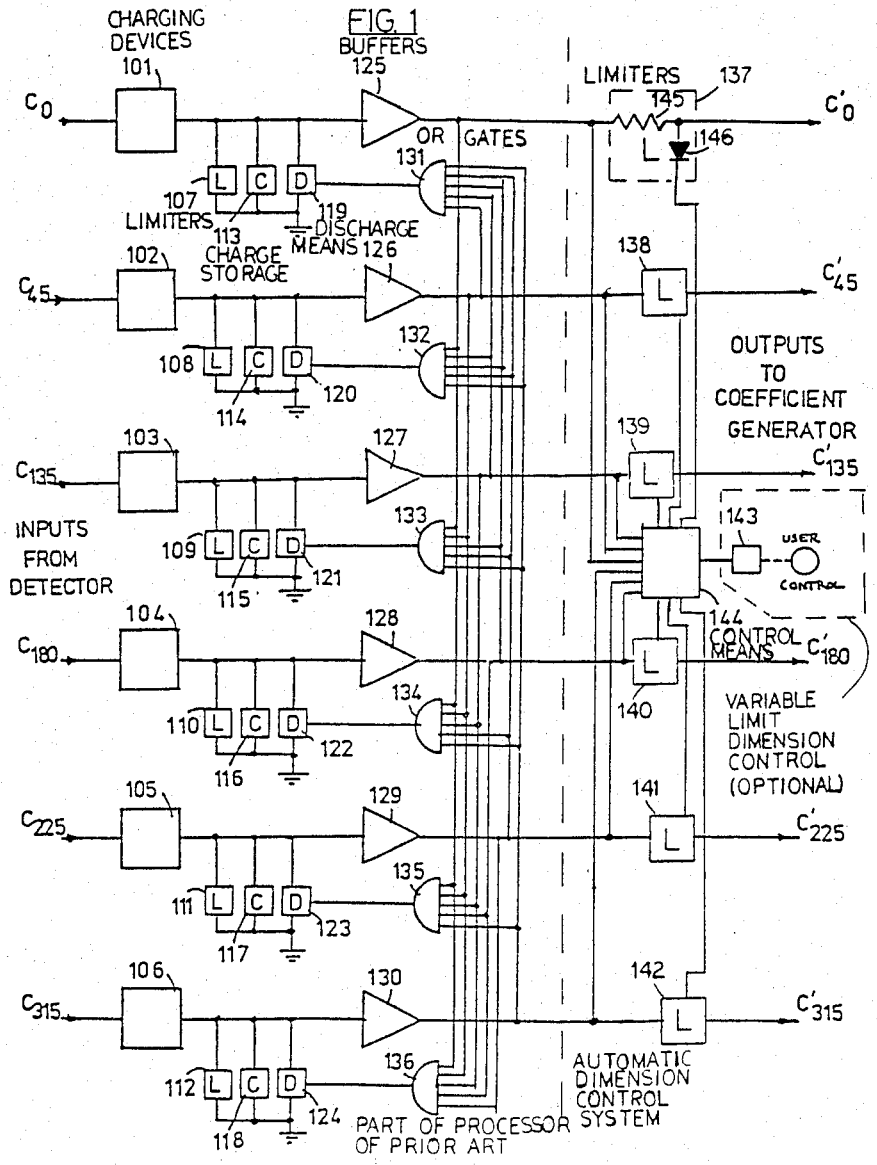
FIG. 1 illustrates a preferred embodiment of the invention.

FIG. 1 of the accompanying drawings, this represents part of the processor of the directional enhancement system, which is described in detail in said U.S. Pat. No. 3,944,735. As shown in FIG. 1, the apparatus comprises charging devices 101 through 106, limiting devices 107 through 112, charge storage devices 113 through 118, discharging devices 119 through 124, buffer amplifiers 125 through 130 and five-input OR gates 131 through 136, providing the six outputs to the coefficient generator section of the processor, which is not shown. As indicated on the Figure, additional limiting devices labeled 137 through 142 may be added at the outputs of the buffer amplifiers 125 through 130 of the processor as stated in said U.S. Pat. No. 3,944,735 and shown in FIG. 7 of that patent, which is also reproduced here as FIG. 2. Limiter 137 is typically constituted by resistor 145 and diode 146.

As also indicated in my co-pending application Ser. No. 799,436 filed Mar. 13, 1978 relating to automatic dimension control apparatus for a directional enhancement system, the additional components labeled 143 and 144 may also be added, component 143 being a manual dimension control and device 144 being the automatic dimension control described in that application.

The component labeled 143 and the limiting devices 137 through 142 form a manual dimension control which provide a variable limit on the maximum value of any control signal present. The effect of this limiting technique is to reduce the maximum separation achieved by the system in a controlled manner, thereby reducing the effective apparent dimensions of the listening room as evidenced by the amount of reverberant sound reproduced in the system. The characteristic described has been found useful in playing some kinds of musical performance in which large amounts of random phase reverberant sound is present.

Figure 2:
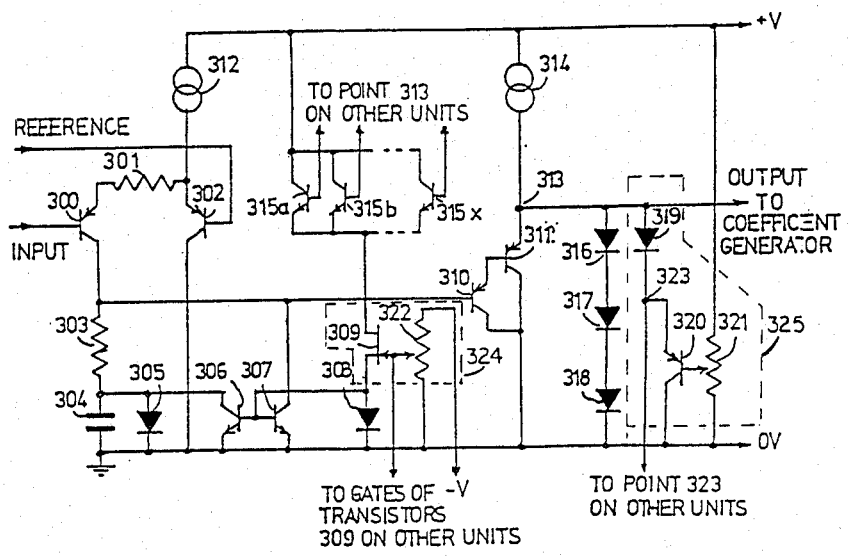
FIG. 2 is a schematic diagram useful in describing the operation of the system of this invention.

Referring now to FIG. 2, the figure shows a typical attack-decay control and limiting section of a processor which is identical in form to that shown in FIG. 7 of said U.S. Pat. No. 3,944,735 with the exception of the added components, namely diode 319, transistor 320, potentiometers 321 and 322, and the substitution of a junction field-effect transistor 309 in place of resistor 309 of that application.

The base of transistor 320 is connected to the slider of potentiometer 321, and its emitter is connected to point 323, a diode being connected from point 323 to each of the points 313 on the several processor sections. When the voltage at the base of transistor 320 is reduced by operating the variable potentiometer 321, the maximum voltage to which the output 313 of any processor unit can rise is limited by diode 319 and transistor 320 to a level less than that which would obtain if these components were not present. When the voltage at the base of transistor 320 is increased, the limiting function reverts to that provided by diodes 316 through 318.

The purpose of field effect transistor 309 and potentiometer 322 is to vary the discharge rate of charge storage device 304 and thereby provide a variable rate dimension control. When the voltage at the gate of field-effect transistor 309 is reduced, the resistance from source to drain increases, and since the voltage applied to the source is fixed, the rate of discharge of capacitor 304 is reduced. Capacitor 304 therefore takes a longer time to discharge. Thus by varying the voltage at the gate of all the transistors 309 of all the processor sections in common, using the variable potentiometer 322, the speed of decay of all the capacitors can be varied together. This characteristic is also useful in the reproduction of musical performances where random phase information occurs, by preventing the decoder from responding too fast to such changes of phase, thereby averaging the response so that the instrument or other sound source remains correctly placed and does not apparently move as the phase changes, while signals having a precise phase relationship and therefore a precisely determined position are still correctly positioned on reproduction of the musical performance.

I claim:

1. In a directional enhancement system for quadraphonic decoders having a matrix quadraphonic decoder, a detector, a processor and a matrix multiplier, said processor being operative to provide a plurality of control signals and including a variable limit dimension control system, said variable limit dimension control system comprising:

a plurality of limiting devices equal in number to the number of control signal outputs provided in said processor, each one of said limiting devices having an input-output terminal coupled to a different one of said control signal outputs of said processor, and a control terminal, said limiting devices being operative to limit the maximum value of the voltage of any said control signals to the voltage present at said control terminal;

a variable control voltage source; and a control device having an input and an output, said input of said control device being coupled to said variable control voltage source and said output of said control device being coupled to said control terminal of each one of said plurality of limiting devices, whereby any control signals developed by said processor are limited to a value less than or equal to the value that would be present in the absence of the dimension control.

2. In a directional enhancement system for quadraphonic decoders having a matrix quadraphonic decoder, a detector, a processor having attack-decay circuits including charge storage devices, and a matrix multiplier, said processor being operative to provide a plurality of control signals and including a variable rate dimension control system, said variable rate dimension control system comprising:

a plurality of voltage variable resistors equal in number to the number of control signals provided in said directional enhancement system, each one of said plurality of voltage-variable resistors having a resistive current path and a control terminal; the resistive current paths each forming part of the discharging devices of the attack-decay control circuits of said processor, and said control terminals being connected in common to an externally variable voltage to vary the rate of decay of charge of each of said charge storage devices forming part of said attack-decay circuit of said processor of said directional enhancement system.

* * * * *